US005674103A

United States Patent [19]

Bean

[11] Patent Number: 5,674,103

[45] Date of Patent: Oct. 7, 1997

[54] SHAPE SORTING BUCKET FOR USE WITH CONSTRUCTION TOY BLOCKS

[75] Inventor: Sandra Bean, Notre-Dame de L'Ile Perrot, Canada

[73] Assignee: The Ritvik Group Inc., Quebec, Canada

[21] Appl. No.: 588,808

[22] Filed: Jan. 19, 1996

[51] Int. Cl.[6] ..... A63H 33/04; A63H 33/26

[52] U.S. Cl. ..... 446/75; 446/118; 446/128; 434/259; 206/457; 220/4.03

[58] Field of Search ..... 446/75, 73, 72, 446/71, 76, 117, 118, 124, 128; 434/258, 259; 206/457; 220/4.03, 4.26, 8

[56] References Cited

U.S. PATENT DOCUMENTS

| | | | |
|---|---|---|---|
| 741,903 | 10/1903 | Gates | 434/258 |
| 1,506,273 | 8/1924 | Smith | 220/8 |
| 2,911,740 | 11/1959 | Miller | 434/258 |
| 3,485,408 | 12/1969 | Benesch | 220/4.26 |
| 4,149,717 | 4/1979 | Seijiro | 434/259 X |
| 4,183,167 | 1/1980 | Jatich | 446/118 |
| 4,604,073 | 8/1986 | Livesey et al. | 446/117 |
| 4,822,314 | 4/1989 | O'Brian et al. | 446/75 |
| 5,035,324 | 7/1991 | Bertrand . | |
| 5,139,453 | 8/1992 | Aiken et al. | 446/75 |
| 5,474,483 | 12/1995 | Sun | 446/75 X |

*Primary Examiner*—Robert A. Hafer
*Assistant Examiner*—D. Neal Muir
*Attorney, Agent, or Firm*—Michael D. Bednarek; Kilpatrick Stockton LLP

[57] ABSTRACT

Disclosed is a shape sorting bucket for use in combination with a set of construction toy blocks having coupling elements that make them detachably stackable onto each other. The bucket is made of three parts including a container defining an enclosure in which the construction toy blocks can be stored, a shape sorting rim extending above the container, this rim having walls provided with holes of different shape, and a lid detachably connectable onto the rim, this lid having an upper surface from which project coupling elements similar to or compatible with those of the construction toy blocks, whereby the lid can be used as a base plate for use to play with the construction toy blocks. Some of the construction blocks are sized and shaped to snugly fit into and thus be sortable through the holes in the walls of the rim, whereby the bucket can also be used as a shape sorting toy. This bucket can be personalized into a character. It is particularly attractive for young children and their parents who may use it in different ways, viz. for sorting shapes, for building up structure made of toy construction blocks, and for storage purpose.

15 Claims, 10 Drawing Sheets

FIG. 8
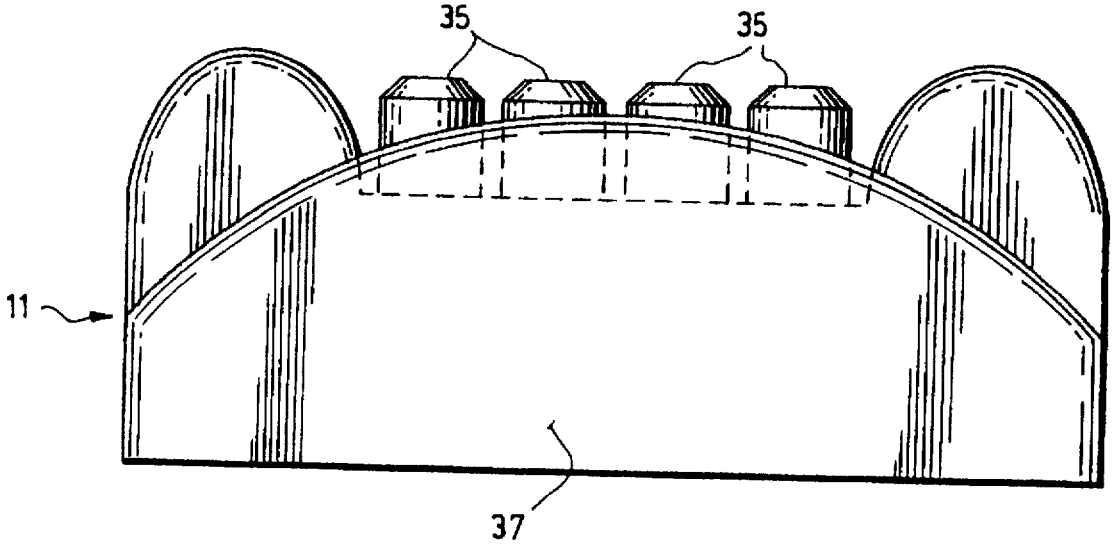
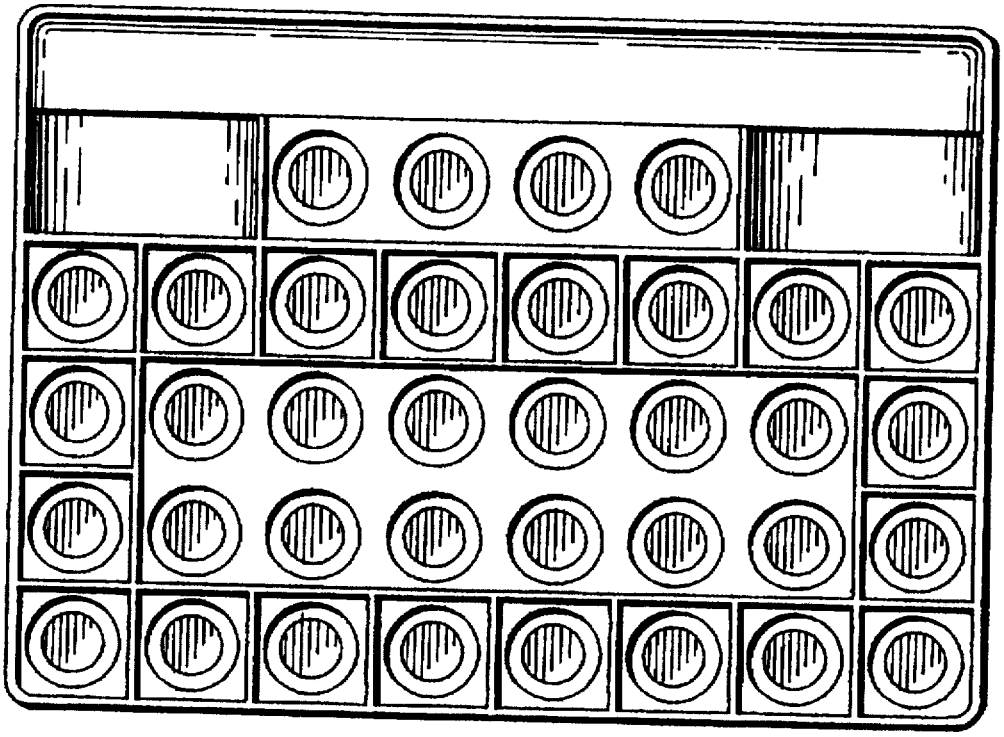
FIG. 11

SHAPE SORTING BUCKET FOR USE WITH CONSTRUCTION TOY BLOCKS

BACKGROUND OF THE INVENTION a) Field of the Invention

The present invention relates to a toy packaging for use to sell, store, put away and play with construction toy blocks of the type having coupling elements that make them detachably stackable onto each other.

More particularly, the invention relates to a toy packaging for use in combination with construction toy blocks of the above mentioned type, which packaging is in the form of a bucket including, on the one hand, a shape sorting rim provided with holes of different shapes through which blocks of similar shapes can be sorted and, on the other hand, a lid shaped as a base plate with coupling elements similar to or compatible with those of the construction toy blocks.

b) Brief Description of the Prior Art

It is of common practise in the toy industry to use buckets made of plastic material as packagings for construction toy blocks like those sold by the Applicant under the trademark MEGA BLOK®.

Such buckets are interesting not only for the toy manufacturers who use them as a packaging to sell their construction toy blocks "in bulk", but also for the consumers who use them to store and put away the blocks originally contained therein.

For obvious retail purpose, it is of the uppermost importance to make the construction toy block buckets as attractive as possible from a visual standpoint. It has also been found very useful from a retail standpoint to construct the buckets in such a manner that they becomes a toy per se and/or they have some of their parts that can be played with the construction toy blocks.

In this connection, reference can be made to U.S. Pat. No. 5,035,324 granted on Jul. 30, 1991 to the present Applicant, which discloses a container for use to sell construction toy blocks. This container acts as a support for a toy hat having a cup-shaped portion sized to fit into a child's head. The hat is preferably provided with coupling elements compatible with those of the construction toy blocks, thereby making it possible for the child to build a structure onto his or her hat.

Reference can also be made to U.S. patent application Ser. No. 08/393,530 filed on Feb. 23, 1995 in the name of the present Applicant, which discloses a bucket for use to sell construction toy blocks. This bucket is provided with a removable lid having an upper surface from which project coupling elements compatible with those of the construction toy blocks, thereby making it useful as a base plate to build up a structure with said blocks.

On the other hand, there presently exist toys specially designed for very young children, which comprise a container closable with a lid provided with holes of different shapes. The container is sold with blocks shaped and sized to fit into and thus be sorted through the holes made in the lid, thereby making it possible for the child to improve his or her visual recognition of the shapes and his or her dexterity.

So far, to the Applicant's knowledge, no one has ever thought of modifying the buckets presently used for selling construction toy blocks in such a manner that such buckets can also be used as shape-sorting toys, eventhough there are numerous advantages to such a combination, not only from a marketing standpoint but also from an educational standpoint.

SUMMARY OF THE INVENTION

Therefore, the object of the present invention is to provide the combination of a shape sorting bucket with a set of construction toy blocks having coupling elements that make them detachably stackable onto each other.

The shape sorting bucket of this combination comprises:

a) a container having a bottom wall and side walls projecting upwardly from the bottom wall and defining there with an enclosure in which the construction toy blocks can be stored, said side walls having upper edges defining together an opening for the enclosure;

b) a shape sorting rim extending above the container, this rim comprising walls hereinafter called "rim walls" which have lower edges connected to the upper edges of the side walls of the container and upper edges defining together an other opening giving access to the enclosure, at least one of the rim walls being provided with holes of different shapes; and c) a lid detachably connectable to the upper edges of the rim walls to close the other opening defined by the upper edges, this lid having an upper surface from which project coupling elements similar to or compatible with those of the construction toy blocks, whereby this lid can be used as a base plate for use to play with said construction toy blocks.

Of course, in this combination, some of the construction toy blocks are and must be sized and shaped to snugly fit into and thus be sortable through the holes provided into the at least one rim wall, whereby the bucket can also be used as a shape sorting toy.

Thanks to its versatile structure, this bucket is particularly attractive for young children and their parents who may use it in different ways, viz. for sorting shapes, for building up structures made of toy construction blocks and for storage purpose.

In accordance with a particularly preferred embodiment of the invention, the blocks that are shaped and sized to snugly fit into and thus be sorted through the holes of different shapes of the shape sorting rim, are themselves construction toy blocks and thus are provided with coupling elements that make them stackable with the other construction toy blocks of the set.

The invention and its numerous other advantages will be better understood upon reading the following non restrictive description of a preferred embodiment thereof, made with reference to the accompanying drawings.

BRIEF DESCRIPTION OF THE DRAWINGS

FIG. 8 is a front elevational view of the lid that is part of the shape sorting bucket shown in FIG. 1;

FIG. 11 appearing on the same sheet of drawings as FIG. 8 is a bottom plan view of the lid shown in FIGS. 8 to 10;

In these drawings, the same reference numerals have been used everywhere to identify the same structural elements.

DESCRIPTION OF A PREFERRED EMBODIMENT OF THE INVENTION

Figure 1:
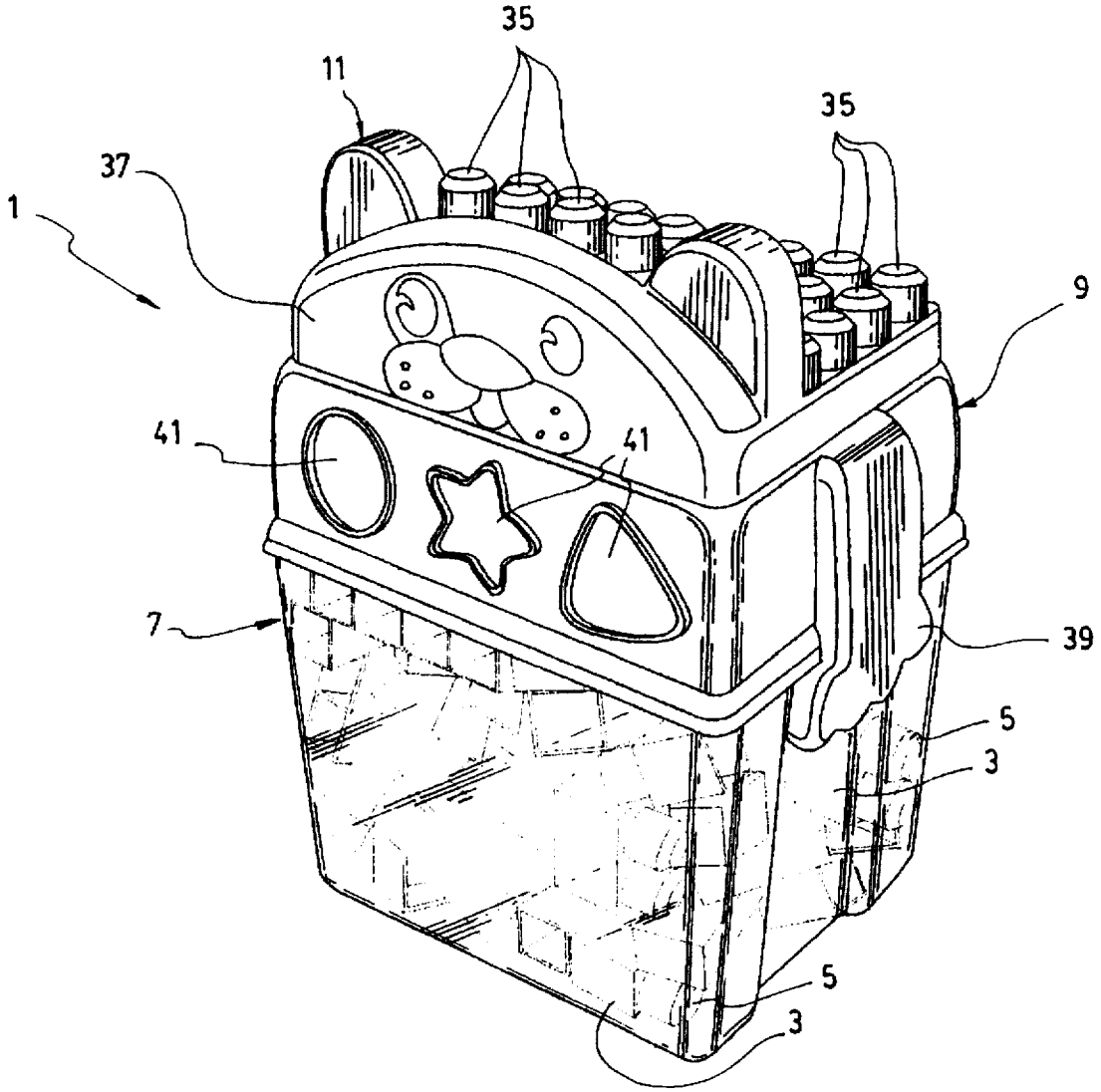
FIG. 1 is a perspective view of a shape sorting bucket according to the invention.

As is shown in FIG. 1, the present invention is concerned with a toy packaging in the form of a bucket (1) which is particularly well adapted for use to sell, store, put away and play with contruction toy blocks (3) having coupling elements (5) that make them detachably stakable onto each other.

More particularly, the invention lies in the combination of the bucket (1) with the construction toy blocks (3) that can be sold and used therewith.

The bucket (1) comprises three basic components, viz. a container (7), a shape sorting rim (9) extending above the container, and a lid (11).

Figure 2:
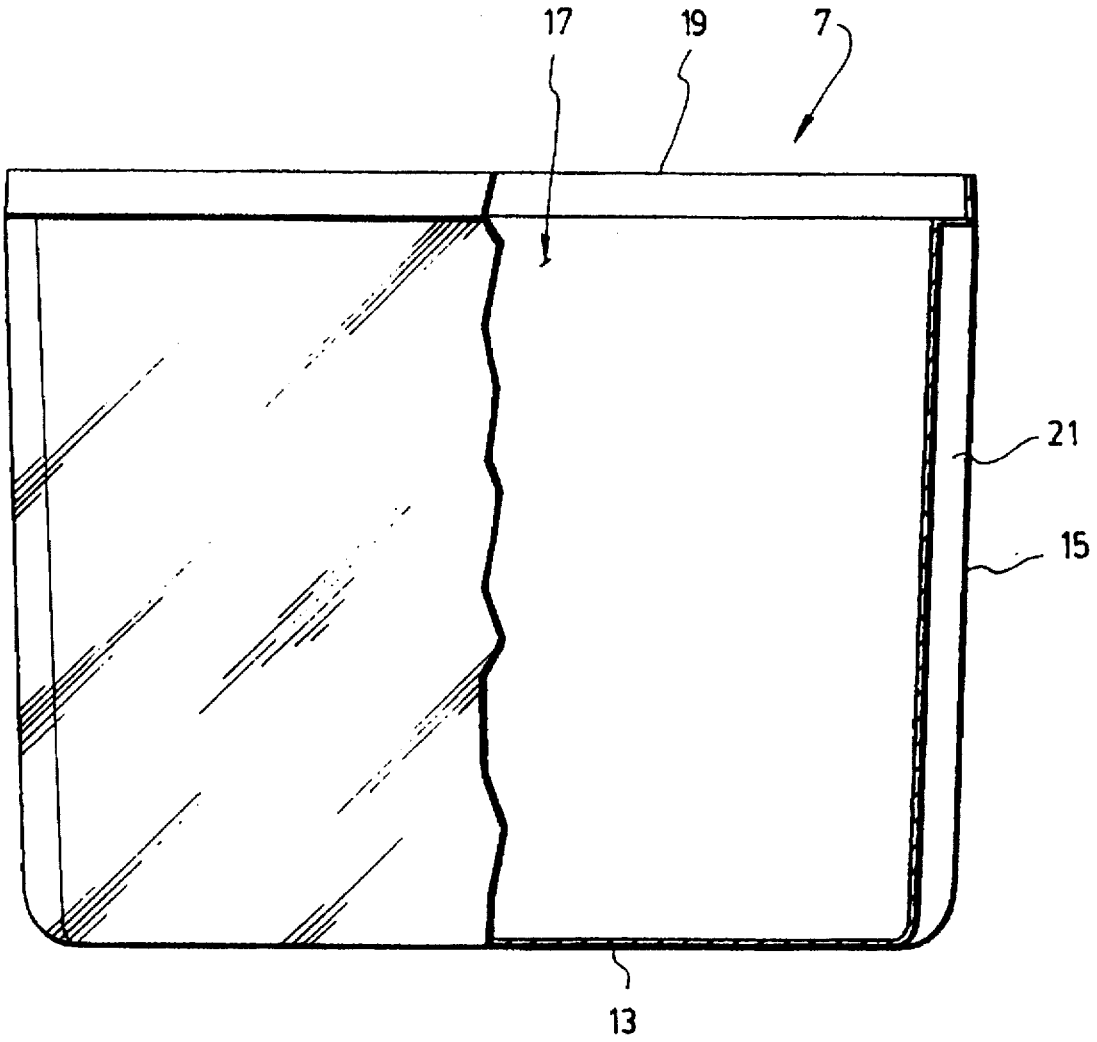
FIG. 2 is a front elevational view in partial cross-section of the container that is part of the shape sorting bucket shown in FIG. 1.
Figure 3:
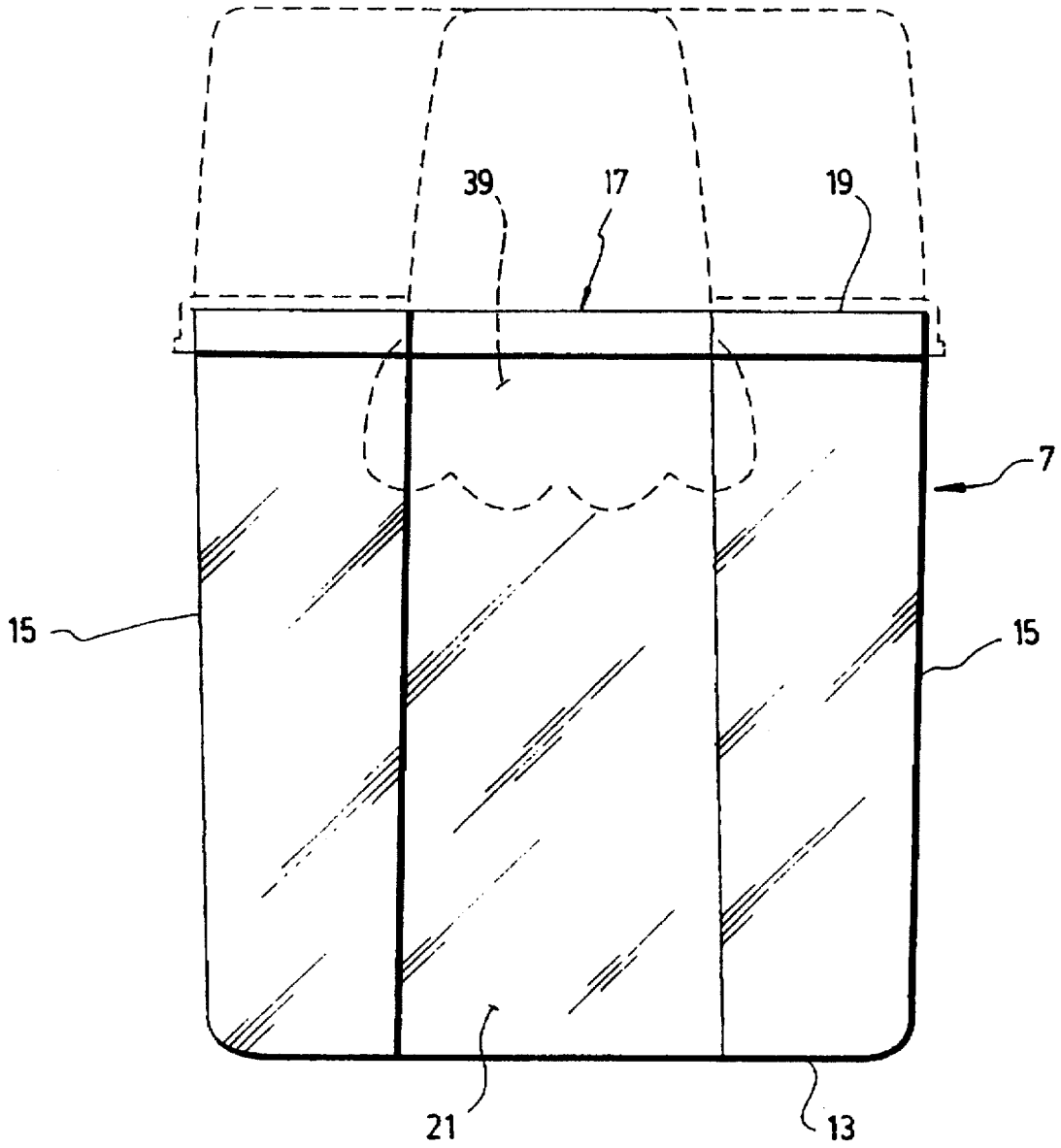
FIG. 3 is a side elevational view of the container shown in FIG. 2, in which part of the shape-sorting rim of the shape-sorting bucket is shown in dotted lines.
Figure 4:
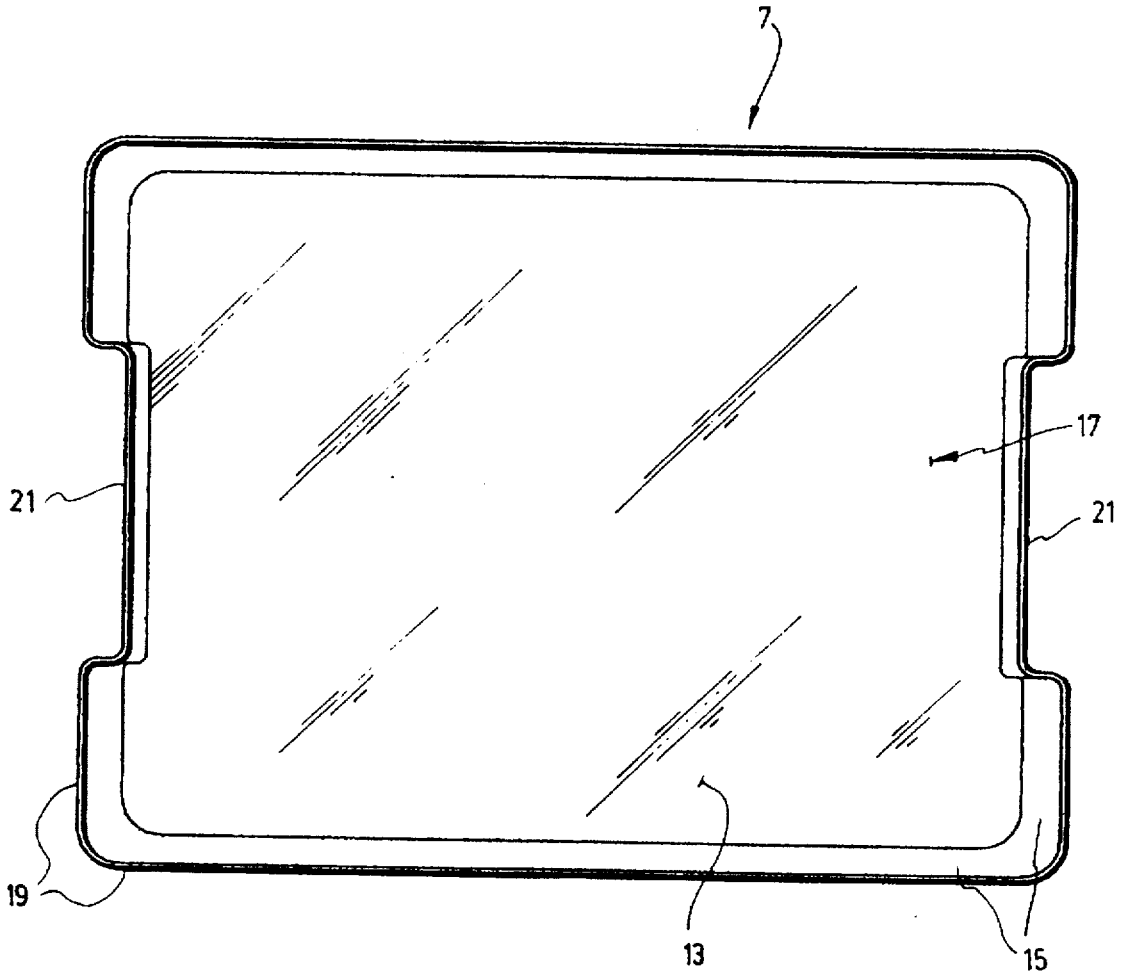
FIG. 4 is a top plan view of the container shown in FIGS. 2 and 3.

As is better shown in FIGS. 2 to 4, the container (7) has a bottom wall (13) and a set of front rear and lateral side walls (15) that project upwardly from the bottom wall and define therewith an enclosure (17) in which the construction toy blocks (3) can be stored. The side walls have upper edges (19) that define together an opening for the enclosure (17).

Preferably, the container (7) is of rectangular cross-section and is provided with built-in recesses 21 in its lateral side walls. Preferably also, the container is made of transparent plastic material to give a visual access to the construction toy blocks (3) stored in it.

Figure 5:
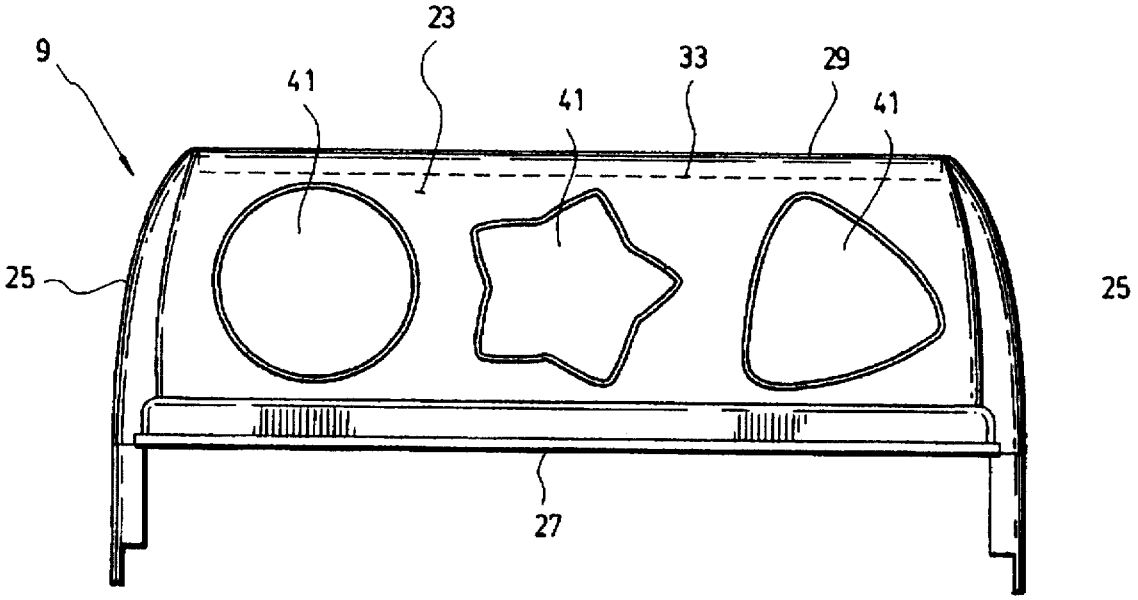
FIG. 5 is a front elevational view of the shape sorting rim that is part of the shape sorting bucket shown in FIG. 1.

As is better shown in FIGS. 5 to 7, the shape sorting rim (9) that extends above the container, comprises walls hereinafter called "rim walls" 23,25 which have lower edges (27) connected to the upper edges (19) of the side walls of the container, and upper edges (29) defining together another opening giving access to the enclosure (17).

Figure 7:
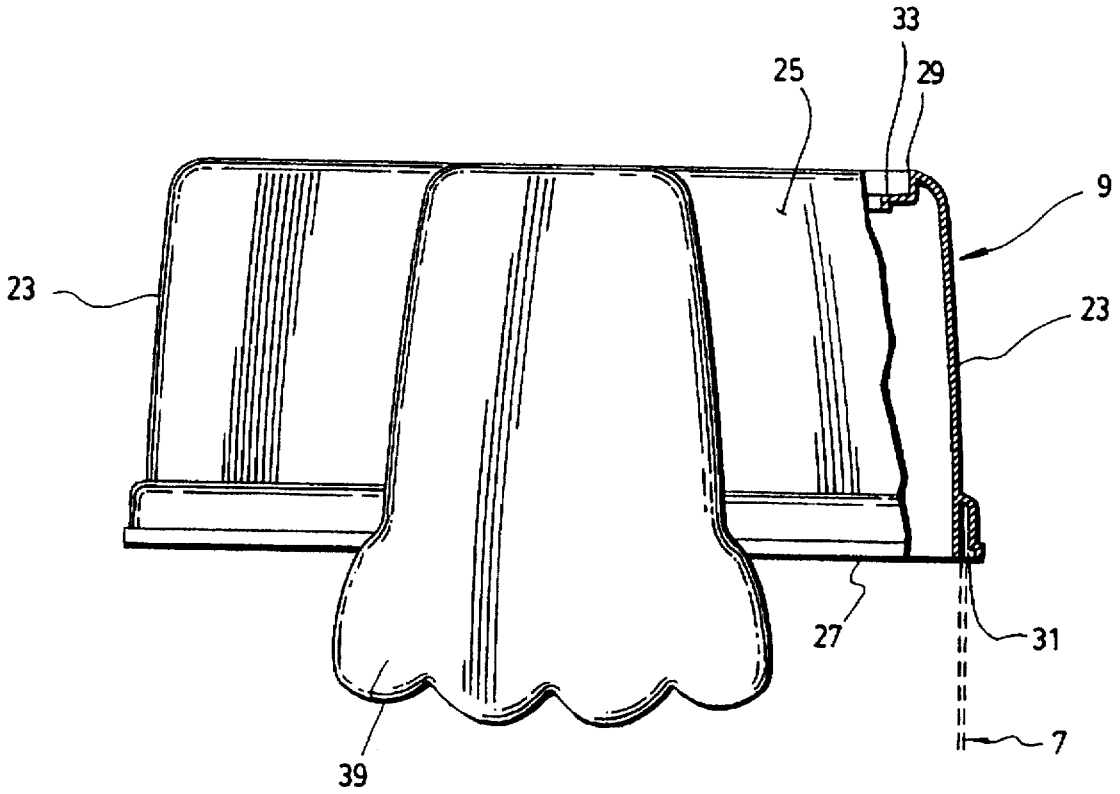
FIG. 7 is a side elevational view in partial cross-section of the shape sorting rim shown in FIG. 5.
Figure 9:
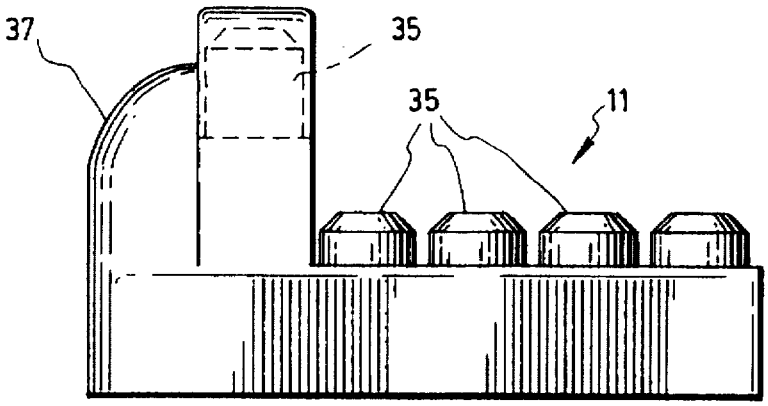
FIG. 9 is a side elevational view of the lid shown in FIG. 8.
Figure 10:
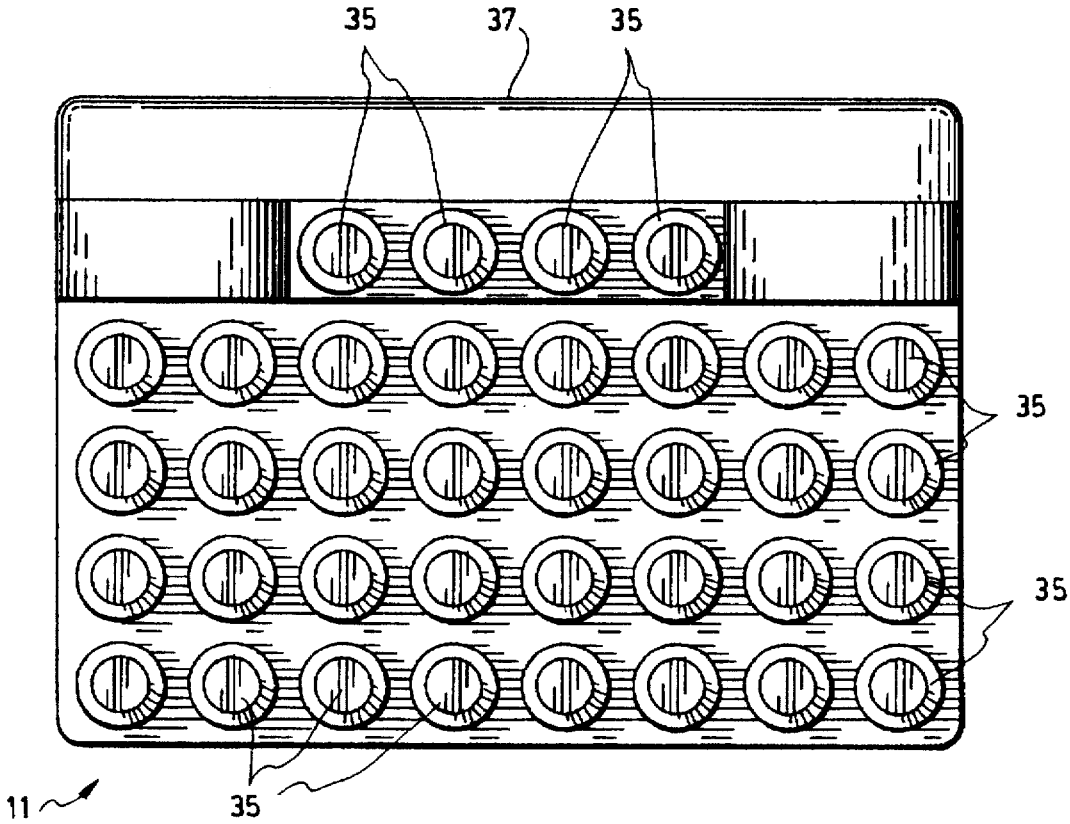
FIG. 10 is a top plan view of the lid shown in FIGS. 8 and 9.

Preferably, the shape sorting rim is slightly tapering upwardly and inwardly and the lower edges (27) of its walls are shaped to define a downwardly opening slot (31) into which the upper edges (19) of the container can be snapped (see FIG. 7). The upper edges (29) of the rim walls are also provided with an inwardly projecting flange 33 defining a peripheral seat (see also FIG. 7).

The lid (11) is devised to be laid onto the seat defined by the flange (33) projecting from the upper edges (29) of the rim walls, so as to close the opening defined by these upper edges.

As is better shown in FIGS. 8 to 11, the lid (11) that is preferably rectangular in shape, has an upper surface from which project coupling elements (35) similar to or compatible with those of the construction toy blocks (3). In the illustrated embodiment, such coupling elements consist of cylindrical studs that are insertable into cavities provided for this purpose in the construction toy blocks (3). As a result, the lid (11) can be used as a base plate for use to play with the construction toy blocks (3) whenever desired.

In accordance with a particularly preferred embodiment of the invention, the lid (11) comprises a front wall (37) that is shaped and decorated to define a character's face that projects above the shape sorting rim. Morever, the rim walls (25) of the shape sorting rim are provided, on both sides of the front wall (37) of the lid, with integral projections (39) that extend downwards over the adjacent lateral side walls of the container (7) and are shaped to define the arms and hands of the character. As a result, the bucket is personalized into the selected character, thereby making it very attractive for children.

As is shown in FIG. 1, this selected character can be a kitten. However, it could also be a puppy, a teddy bear or any other children attractive character.

Preferably, the arm and hand defining projections (39) that project from the lateral rim walls (25), are formed to also define a pair of lateral handles that extend over the built-in recesses made in the adjacent side walls of the container (7). Such substantially facilitates grasping of these handles and handling of the bucket whenever required.

For obvious manufacturing, marketing and safety reasons, the container, the shape sorting rim and the lid are preferably made of plastic material of attractive colors, and they all have rounded edges and corners.

In accordance with the present invention, the shape sorting rim (9) of the bucket (1) disclosed hereinabove is provided with holes (41) of different shapes into one or more of its walls. In the illustrated embodiment, the rim (9) comprises three holes in its front wall (23) and three other holes in its rear wall. These holes which are illustrated in FIGS. 5 and 6*a* to 6*c*, are preferably shaped as a circle, a star, a triangle, a heart, a flower and a square.

Figure 12:
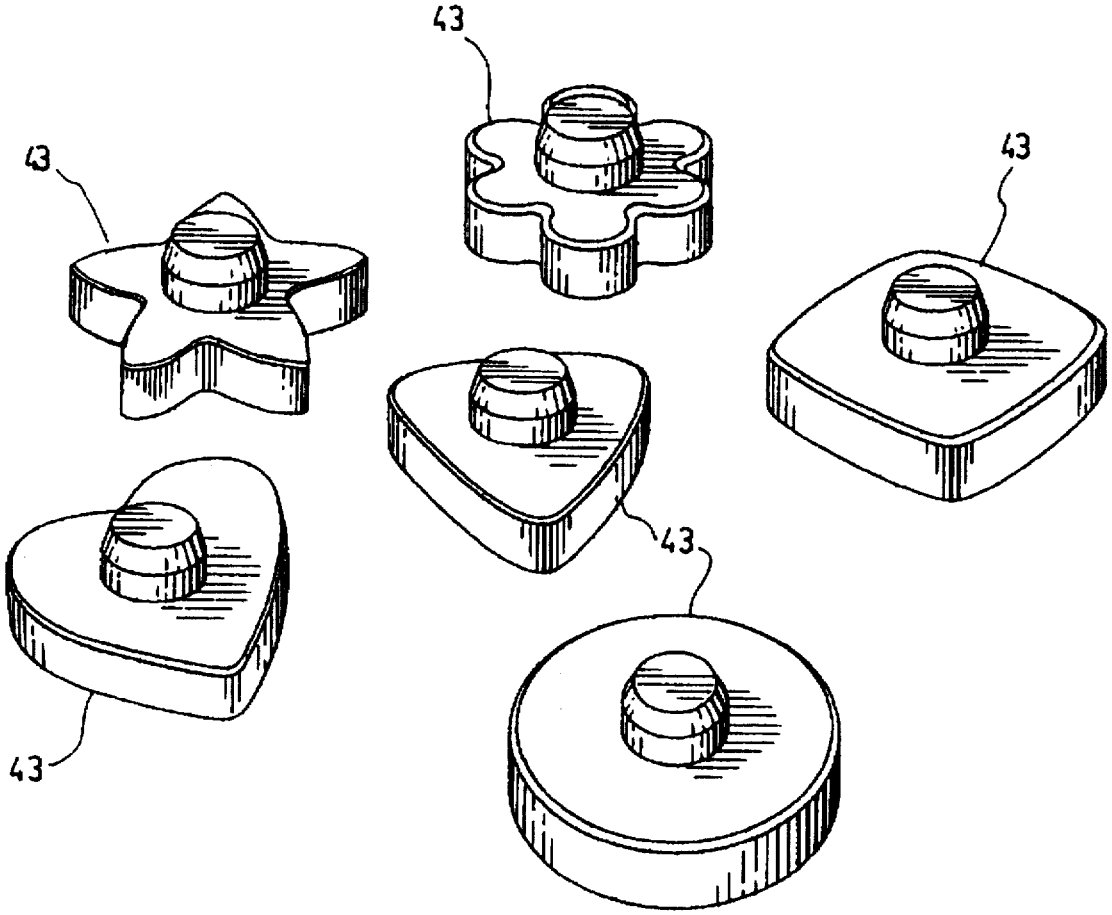
FIG. 12 is a top perspective view of the six toy blocks intended to be sorted with the shape sorting bucket shown in the preceding Figure.

These holes (41) are intended to "cooperate" with construction toy blocks (43) of corresponding shapes (see FIGS. 12 to 14) that are part of the set enclosed within the container.

The toy blocks (43) of corresponding shapes are actually sized and shaped to snugly fit into and thus be sortable through the holes (41) provided into the rim walls, whereby the bucket (1) can also be used as a shape sorting toy.

Figures 6A, 6B, 6C:
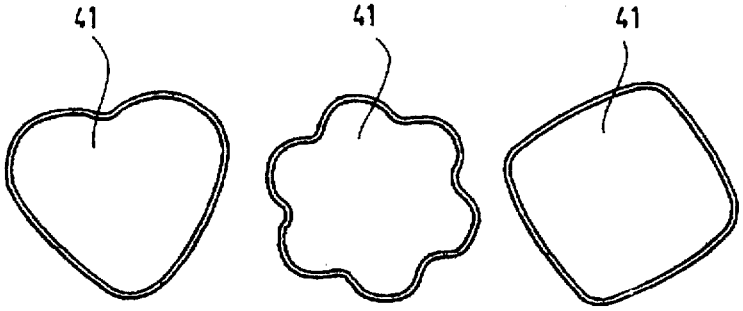
FIGS. 6*a* to 6*c* are front elevational views of the shape sorting holes made in the rear side of the shape sorting rim.
Figure 13:
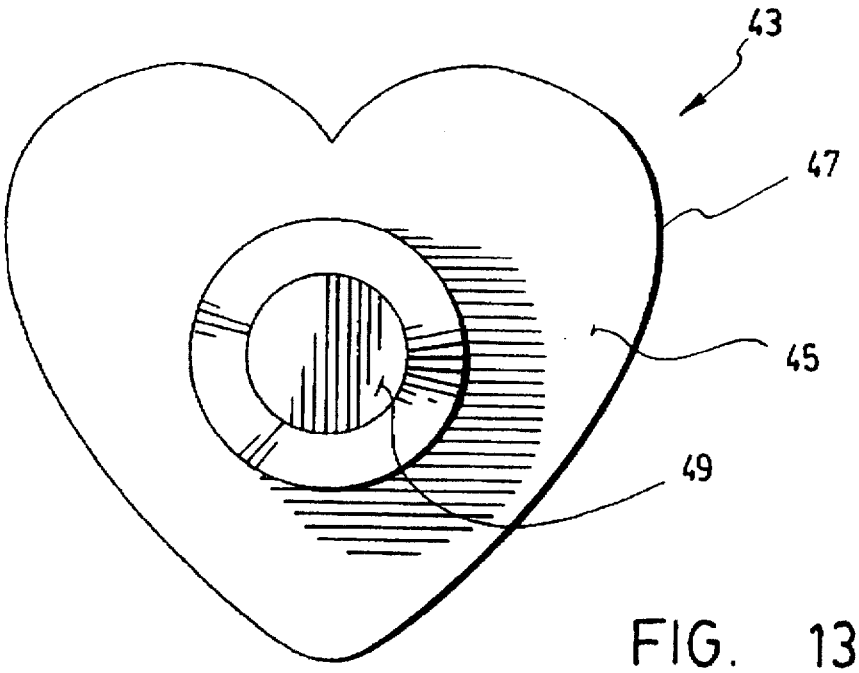
FIG. 13 is a top plan view of the heart-shaped toy block shown in FIG. 12.
Figure 14:
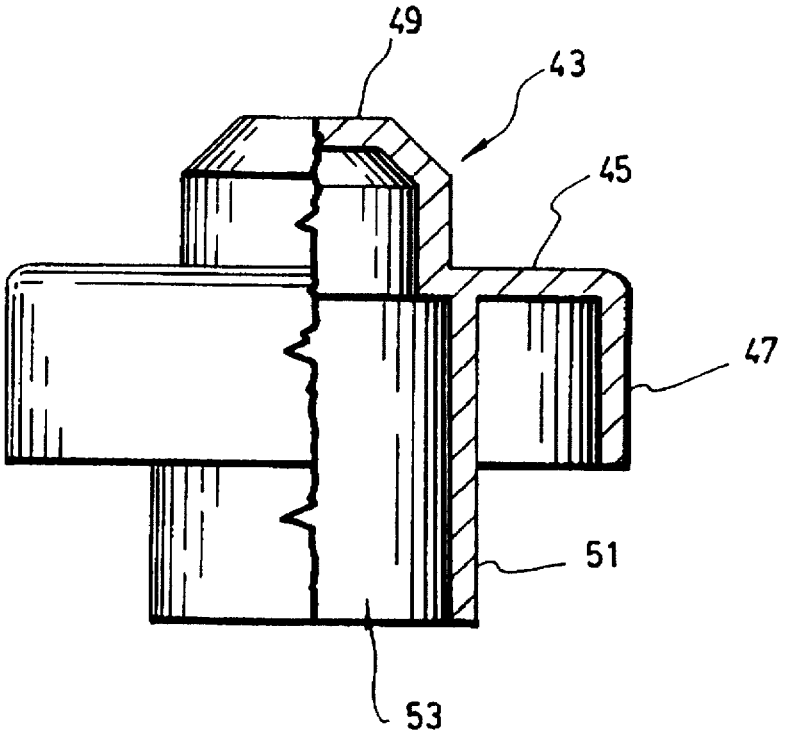
FIG. 14 is a side elevational view in partial cross-section of the heart-shaped toy block shown in FIGS. 12 and 13.

As is better shown in FIGS. 13 and 14 which show the heart-shaped toy block 43 intended to be sorted through the hole 41 shown in FIG. 6*a*, each block 43 comprises:

- a central portion (45) having peripheral walls (47) shaped and sized to snugly fit into the corresponding hole,
- a cylindrical stud (49) projecting centrally and upwardly from the central portion, this stud being similar to those of the other construction toy blocks, and
- a leg (51) projecting centrally and downwardly from the central portion, this leg having a counterbore (53) sized to receive any one of the cylindrical studs of the other blocks (3) or 43 and/or the lid 11.

As can now be understood, the shape sorting bucket (1) is very attractive for children (and their parents) who may use it in numerous way, viz. for sorting shapes, building up structures made of construction toy blocks, storing the blocks, etc.

In use, the bucket (1) can be sold as is shown in FIG. 1, with small pieces of plastic material or cardboard to close the holes (41) and thus prevent tampering with the container. Alternatively, it can be sold in closed boxes.

Of course, numerous modification could be made to the preferred embodiment that has just been disclosed without departing from the scope of the present invention as defined in the appended claims.

What is claimed is:

1. The combination of a shape sorting bucket with a set of construction toy blocks having coupling elements that make them detachably stackable onto each other, wherein:

said shape sorting bucket comprises:

a) a container having a bottom wall and side walls projecting upwardly from said bottom wall and defining therewith an enclosure in which said construction toy blocks can be stored, said side walls having upper edges defining together an opening for said enclosure;

b) a shape sorting rim extending above said container, said rim comprising walls hereinafter called "rim walls" which have lower edges connected to the upper edges of the side walls of the container and upper edges defining together an other opening giving access to said enclosure, at least one of said rim walls being provided with holes of different shapes; and c) a lid detachably connectable to the upper edges of the rim walls to close the other opening defined by said upper edges, said lid having an upper surface from which project coupling elements similar to or compatible with those of the construction toy blocks, whereby said lid can be used as a base plate for use to play with said construction toy blocks, and some of said construction toy blocks are sized and shaped to snugly fit into and thus be sortable through the holes provided into said at least one rim wall whereby said bucket can also be used as a shape sorting toy.

2. The combination of claim 1, wherein:

said coupling elements consist of cylindrical studs insertable into cavities made in the construction toy blocks; and each of the construction toy blocks that are sized and shaped to be sortable through the holes of said at least one rim wall comprises:

a central portion having peripheral walls shaped and sized to snugly fit into one of said holes, a cylindrical stud projecting centrally and upwardly from said central portion, said stud being similar to those of the other construction toy blocks, and a leg projecting centrally and downwardly from said central portion, said leg having a counter bore sized to receive any one of said cylindrical studs.

3. The combination of claim 2, wherein:

said lid comprises a front wall that is shaped and decorated to define a character's face that projects above the shape sorting rim; and the rim walls of said shape sorting rim are provided on both sides of the front wall of said lid with integral projections that extend downwards over the adjacent side walls of the container, said projections being shaped to define arms and hands, whereby said shape sorting bucket is personalized into said character, thereby making it very attractive for your children.

4. The combination of claim 3, wherein the container, the shape sorting rim and the lid of the shape sorting bucket are of generally rectangular cross-section;

the shape sorting rim is slightly tapering upwardly and inwardly;

the rim walls of the shape sorting rim comprises a front rim wall, a rear rim wall and a pair of rim walls; and the arm and hand-defining projections of the rim walls are parts of said lateral rim walls and are formed so as to also define a pair of lateral handles.

5. The combination of claim 4, wherein:

the holes of different shapes of the shape sorting rim are provided in the front and rear rim walls, exclusively.

6. The combination of claim 5, wherein:

the container is made of transparent plastic material to give a visual access to the construction toy blocks stored in it; and said container is provided with built-in recesses in its side walls adjacent to the handle-defining projections of the shape sorting rim to facilitate grasping of said projections whenever required.

7. The combination of claim 6, wherein:

the lower edges of the rim walls are shaped to define a downwardly opening slot into which the upper edges of the container can be snapped; and the upper edges of the rim walls are provided with an inwardly projecting flange defining a peripheral seat on which the lid can be laid.

8. The combination of claim 1, comprising six of said holes of different shapes of the shape sorting rim, said six holes being respectively shaped as a circle, a star, a triangle, a heart, a flower and a square.

9. The combination of claim 1, wherein all of said container, shape sorting rim and lid are made of plastic material and have rounded edges and corners.

10. The combination of claim 9, wherein the character into which the shape sorting bucket is personalized is selected from the group consisting of teddy bears, puppies and kittens.

11. The combination of claim 1, wherein:

said lid comprises a front wall that is shaped and decorated to define a character's face that projects above the shape sorting rim; and the rim walls of said shape sorting rim are provided on both sides of the front wall of said lid with integral projections that extend downwards over the adjacent side walls of the container, said projections being shaped to define arms and hands, whereby said shape sorting bucket is personalized into said character, thereby making it very attractive for your children.

12. The combination of claim 11, wherein the container, the shape sorting rim and the lid of the shape sorting bucket are of generally rectangular cross-section;

the shape sorting rim is slightly tapering upwardly and inwardly;

the rim walls of the shape sorting rim comprises a front rim wall, a rear rim wall and a pair of rim walls; and the arm and hand-defining projections of said rim walls are parts of said lateral rim walls and are formed to also define a pair of lateral handles.

13. The combination of claim 12, wherein:

the container is made of transparent plastic material to give a visual access to the construction toy blocks stored in it; and said container is provided with built-in recesses in its side walls adjacent to the handle-defining projections of the shape sorting rim to facilitate grasping of said projections whenever required.

14. The combination of claim 13, wherein:

the lower edges of the rim walls are shaped to define a downwardly opening slot into which the upper edges of the container can be snapped; and the upper edges of the rim walls are provided with an inwardly projecting flange defining a peripheral seat on which the lid can be laid.

15. The combination of claim 14, wherein all of said container, shape sorting rim and lid are made of plastic material and have rounded edges and corners.

* * * * *